United States Patent [19]

Sugiyama et al.

[11] Patent Number: 4,785,579

[45] Date of Patent: Nov. 22, 1988

[54] CIRCULAR DOOR OPERATING METHOD AND APPARATUS

[75] Inventors: Kiyoaki Sugiyama, Akashi; Keizo Fujii, Tokyo; Shigemitsu Shimoyama, Ageo, all of Japan

[73] Assignees: Nippon Air Brake Co., Ltd.; Tajima Junzo Seisakusho Co., Ltd., both of Tokyo, Japan

[21] Appl. No.: 151,278

[22] Filed: Feb. 1, 1988

[30] Foreign Application Priority Data

| | | | |
|---|---|---|---|
| Mar. 19, 1987 | [JP] | Japan | 62-065069 |
| Mar. 19, 1987 | [JP] | Japan | 62-065070 |
| Mar. 19, 1987 | [JP] | Japan | 62-040748[U] |
| Mar. 19, 1987 | [JP] | Japan | 62-040749[U] |
| May 21, 1987 | [JP] | Japan | 62-076314[U] |

[51] Int. Cl.[4] ..... E06B 3/34; E05B 65/10

[52] U.S. Cl. ..... 49/40; 49/118; 49/141; 49/177

[58] Field of Search ..... 49/40, 41, 141, 118, 49/123, 177, 179, 189, 188

[56] References Cited

U.S. PATENT DOCUMENTS

| | | | |
|---|---|---|---|
| 931,502 | 8/1909 | Schureman | 49/40 |
| 3,491,483 | 1/1970 | Miller | 49/141 |
| 4,063,388 | 12/1977 | Little | 49/141 X |
| 4,458,447 | 7/1984 | Heise et al. | 49/44 |
| 4,598,495 | 7/1986 | Labarile | 49/41 |

FOREIGN PATENT DOCUMENTS

| | | | |
|---|---|---|---|
| 1089960 | 10/1954 | France | 49/40 |
| 57-130687 | 8/1982 | Japan . | |
| 61-123180 | 8/1986 | Japan . | |
| 1300576 | 12/1972 | United Kingdom | 49/141 |

*Primary Examiner*—Philip C. Kannan
*Attorney, Agent, or Firm*—Takeuchi Patent Office

[57] ABSTRACT

A circular door operating method and apparatus comprising two pairs of arcked door leaves, two pairs of arcked fixed panels arranged so as to form an enclosure defining a cylindrical wind blocking compartment. Each door leaf is hinged at an end and releasably coupled at the other end to a hanger assembly traveling on a circular track by means of a pulley mechanism. When a door leaf is released from the hanger assembly to pivot about upper and lower hinge mechanisms for operation as a hinged door, not only the upper and lower hinge mechanisms firmly support the door leaf in place but also a control unit disables the sliding door operation, thus providing a quick and safe escape from the building in the event of an emergency.

7 Claims, 8 Drawing Sheets

FIG. 14
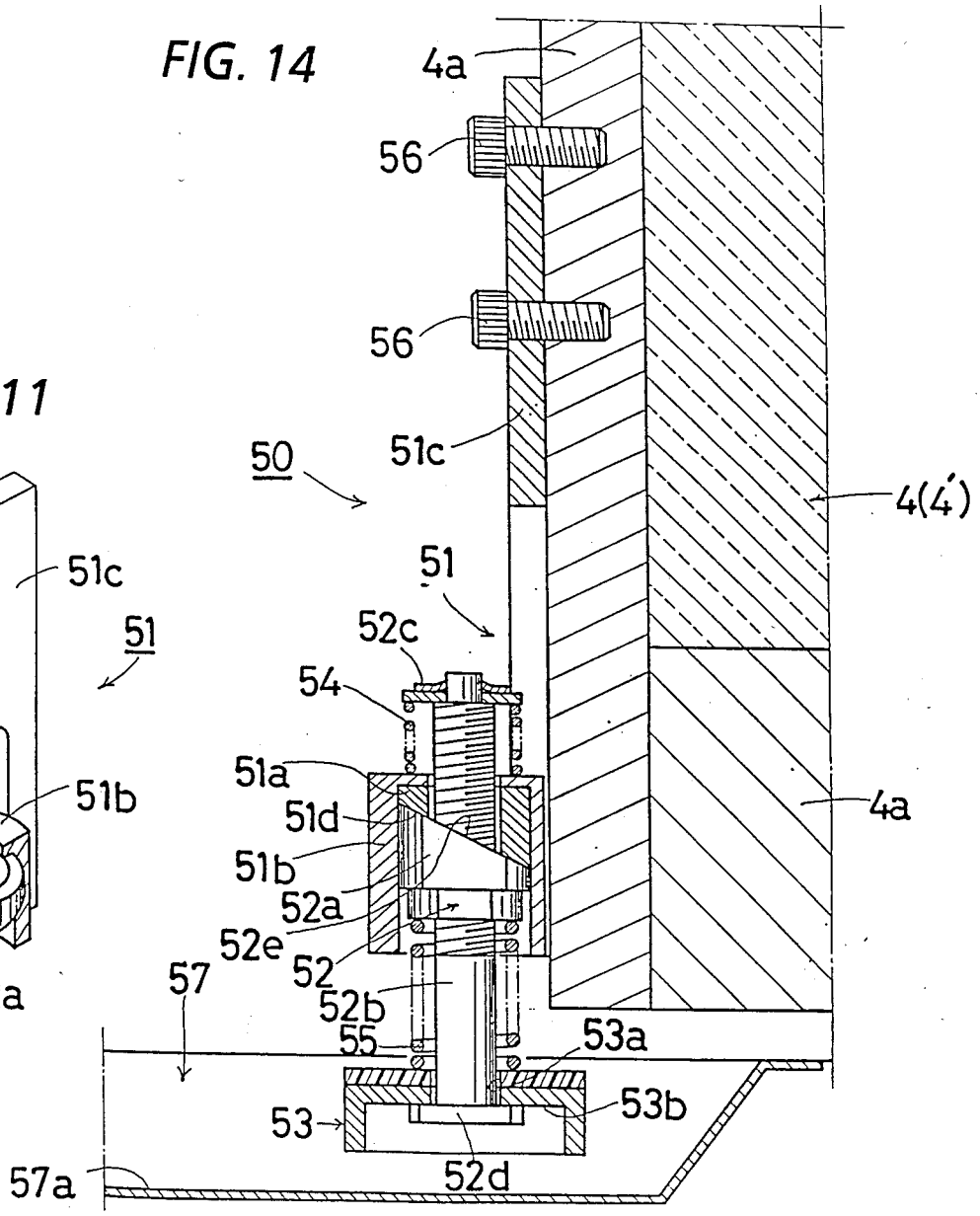
FIG. 11
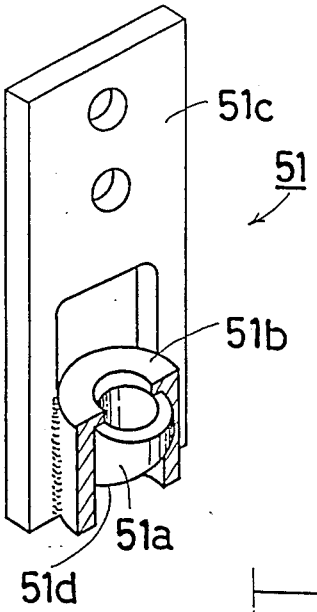
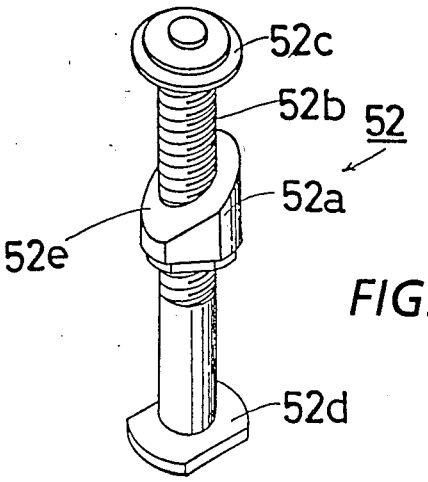
FIG. 12
FIG. 13
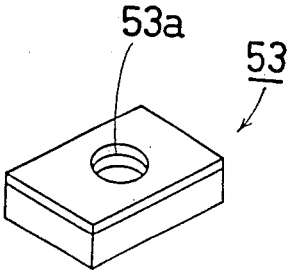

CIRCULAR DOOR OPERATING METHOD AND APPARATUS

BACKGROUND OF THE INVENTION

The present invention relates generally to methods and apparatus for operating a circular door assembly and, more particularly, to a method and apparatus for operating a center-open sliding door assembly.

Recently, many attempts have been made to improve apparatus for operating a center-open sliding door assembly installed at a passage of a building. FIG. 19 shows a conventional circular door assembly made up of two pairs of arcked door leaves A, each pair constituting a center-open inside door F at the inside D of a building or a center-open outside door G at the outside E, and two pairs of similarly arcked fixed panels B, each pair installed on opposite sides of the inside door F or outside door G, forming an enclosure defining a cylindrical wind blocking compartment C between the inside D and the outside E. A passenger sensor H installed in front of or at the back of the inside door F or outside door G senses the presence of a passenger or passengers to provide a signal. In response to the signal, a drive mechanism opens the corresponding door F or G. Usually, each door leaf A is slidably retreated along the corresponding curved fixed panel B.

However, these center-open sliding doors F and G open so slowly that there is a danger of blocking the passengers seeking safety in flight in the event of an emergency such as a fire or earthquake. When there is a power failure, the doors are not automatically opened so that the evacuees must open them manually, making the evacuation more difficult.

SUMMARY OF THE INVENTION

Accordingly, it is an object of the invention to provide a method and apparatus for operating a circular door assembly which allows speedy evacuation in the event of an emergency.

According to one aspect of the invention there is provided a method of operating a circular door assembly, which comprises the steps of providing a closed curved transom and a closed curved floor channel installed at a passage of a building; pivotally mounting a pair of center-open, sliding curved doors between the curved transom and floor channel and two pairs of opposing curved fixed panels, each pair provided on opposite sides of each of the doors, so as to form an enclosure defining a wind blocking compartment and on the inside of each of the doors so as to allow each of the doors to pivot toward the outside of the building; and releasably coupling central part of each door to the transom in such a manner that a passenger may open the door as a hinged door by simply pushing the central part of the door toward the outside, thus allowing rapid evacuation from the building in the case of an emergency.

According to another aspect of the invention there is provided an apparatus for operating a circular door assembly, which comprises a closed curved transom enclosing a curved track; a closed curved floor channel provided at a passage of a building; two pairs of door leaves, each pair forming a center-open, sliding curved door provided between the curved transom and the floor channel; two pairs of curved fixed panels, each pair provided on opposite sides of each of the curved doors so as to form an enclosure defining a wind blocking compartment and on the inside of each of the curved doors so as to allow the door to pivot toward the outside of the building; two pairs of hanger assemblies, one for each door leaf to slidably mount the door leaf on the curved track; a pair of pulley mechanisms, one for each door to move a pair of door leaves of the door in opposite directions along the track to thereby open or close the passage; upper and lower hinge mechanisms secured to a hinged side of each door leaf to pivotally mount the door leaf on the curved transom and the curved floor channel, respectively; and releasable coupling means for releasably coupling a free end of each door leaf to each of the hanger assemblies so that a passenger may open the center-open slinding door as a hinged door by simply pushing a central part of the center-open sliding door.

According to the invention, the center-open sliding doors can be opened as hinged doors so that passengers seeking safety in flight can leave the building very quickly in the event of an emergency. That is to say, there is no need to wait for the center-open sliding doors to open sufficiently wide to allow passengers to pass through. In addition, in the case of a power failure, it is not necessary to manually slide open the doors but merely push the center of the door toward the outside for pivotally open the door providing a rapid escape to the outside.

When each door leaf is released from the hanger assembly through the releasable coupling means, the upper and lower hinge mechanisms firmly support the door leaf between the track and the floor channel allowing only pivotal movement of the door leaf about the upper and lower hinge mechanisms thus assuring safe operation of the center-open sliding door as a hinged door.

Other objects, features, and advantages of the invention will be apparent from the following description taken in conjunction with the accompanying drawings.

BRIEF DESCRIPTION OF THE DRAWINGS

FIGS. 11–13 are perspective views of a cylinder cam, a lower plunger, and a lower abutment, respectively, of a lower hinge mechanism useful for the appratus of FIG. 1;

FIG. 14 is a sectional view of the lower hinge mechanism secured to the lower side of a door;

DESCRIPTION OF THE PREFERRED EMBODIMENTS

Figure 1:
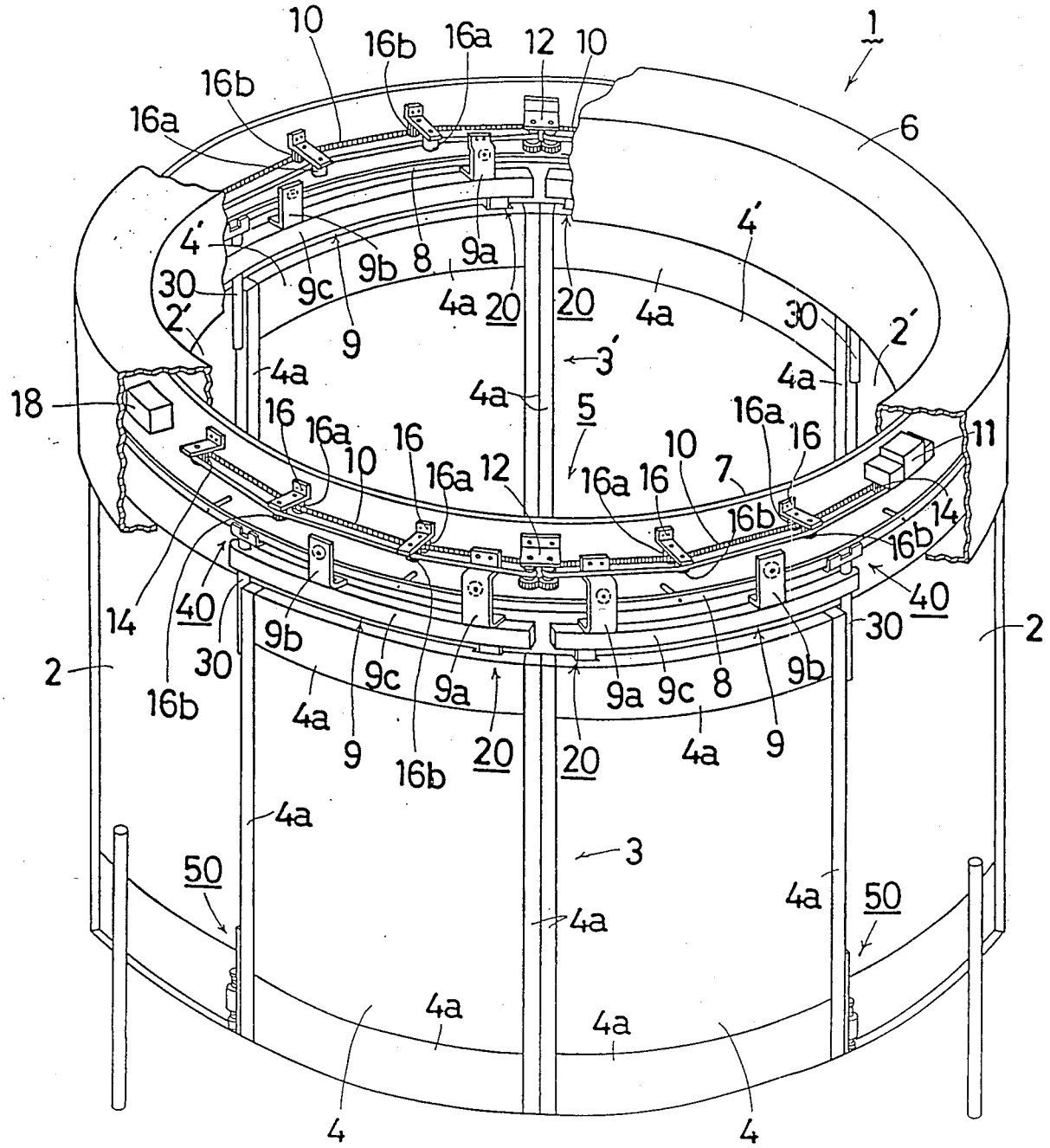
FIG. 1 is a perspective view, partially broken away, of a circular door operating apparatus according to an embodiment of the invention.

FIG. 1 shows a circular door operating apparatus according to an embodiment of the invention. The circular door operating apparatus 1 to be installed at a passage of a building to open or close the passage to the outside (the front side in this figure) includes a pair of arcked outside fixed panels 2, a pair of arcked outside door leaves 4 mounted between the outside fixed panels 2 forming a center-open outside door 3, a pair of arcked inside fixed panels 2', and a pair of arcked inside door leaves 4' forming a center-open inside door 3'. These arcked door leaves and fixed panels cooperate to form an enclosure defining a cylindrical wind blocking compartment 5. Provided above these arcked door leaves and fixed panels is a circular transom 6 which encloses a circular frame 7, a circular or a pair of semi-circular tracks 8 mounted on the circular frame 7 with appropriate mounts, and four door hanger assemblies 9, one for each door leaf, traveling on the tracks 8 with hanger rolls to carry each door.

The door hanger assembly 9 includes a pair of hanger members 9*a* and 9*b*, each having a hanger roll running on the track 8, and an arcked support beam 9*c* connecting the hangers 9*a* and 9*b*. The generally U-shaped hanger 9*a* is secured at an end to a timing or pulley belt 10 so that when a drive mechanism 11 circulates the timing belt, the door leaves 4 releasably coupled to the support beams 9*c* are moved along the circular track 8. An outside door driving system consisting of the door hanger assembly 9, pulley belt 10, and a drive mechanism 11, is mounted on the outside of the circular frame 7, whereas an inside door driving system consisting of similar elements to those of the outside door driving system is mounted on the inside of the circular frame 7. These driving systems are controlled by a controller 18 mounted on the circular frame 7.

Figure 2:
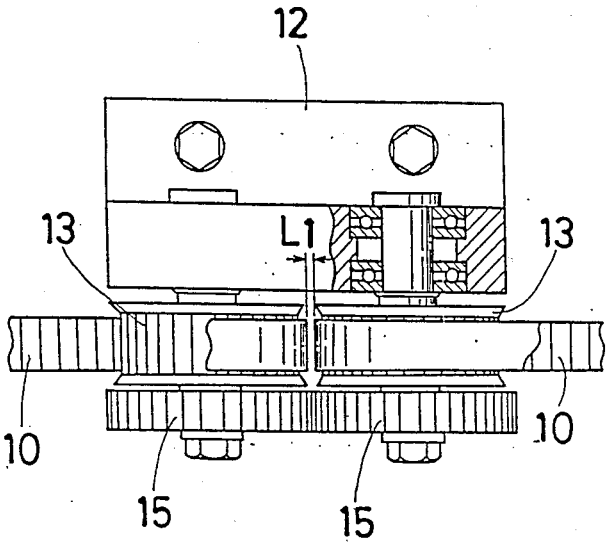
FIG. 2 is a front view, partially broken away, of a center pulley assembly useful for the apparatus of FIG. 1.

The outside door leaves 4 and inside door leaves 4' are arranged so as to slide along the outside of the fixed panels 2 and the inside of the fixed panels 2', respectively. That is to say, all the door leaves are arranged toward the outside of a building with respect to the corresponding fixed panels. A timing pulley belt 10 is provided for each door leaf 4 and streached across a center pulley 13 (FIG. 2) journaled to a central bracket 12 and a idle pulley 14 journaled to a bracket secured to the circular frame 7 above the fixed panel 2. As best shown in FIG. 2, a pair of toothed wheels 15 each journaled to the center bracket 12 with the same shaft as the center pulley 13 are meshed with each other so that a pair of pulley belts 10 may travel simultaneously in opposite directions by means of a single drive mechanism 11. The center pulleys 13 are disposed in such a manner that the distance (L1) between the outsides of the timing belts 10 around the pulleys 10 may be smaller than the height or difference beween the crest and the valley of teeth of the center pulleys 13 and timing belts 10, thus preventing disengagement or slipping betwen the belt 10 and the pulley 13.

Figure 3:
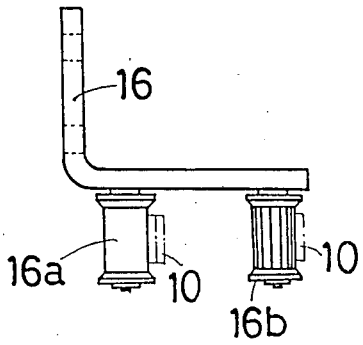
FIG. 3 is a side view of guide rollers useful for the appratus of FIG. 1.

A plurality of L-shaped brackets 16 are secured on the circular frame 7, with a pair of guide rollers 16*a* and 16*b* journaled to the horizonatal leg of each bracket 16 stretching the timing belt 10 along the circular frame 7. As best shown in FIG. 3, the guide roller 16*a* has no teeth and abuts the back side of the belt 10, whereas the guide roller 16*b* has a toothed surface so as to mesh with the toothed side of the belt 10.

In addition to the sliding door function as described above, the circular door assembly of the invention is designed to operate as a hinged door. That is to say, each door leaf 4 is releasably coupled to the support beam 9*c* of the hanger assembly 9 through a releasable coupling device 20 in such a manner that the center side of a door leaf may be easily released from the support beam 9*c* by applying a pressure toward the outside. The other end of the door leaf 4 is secured to a rotatable shaft 30 which is pivotally mounted on the support beam 9*c* so that the door leaf may be turned about the rotatable shaft 30 toward the outside when it is released from the support beam 9*c*.

Figure 4:
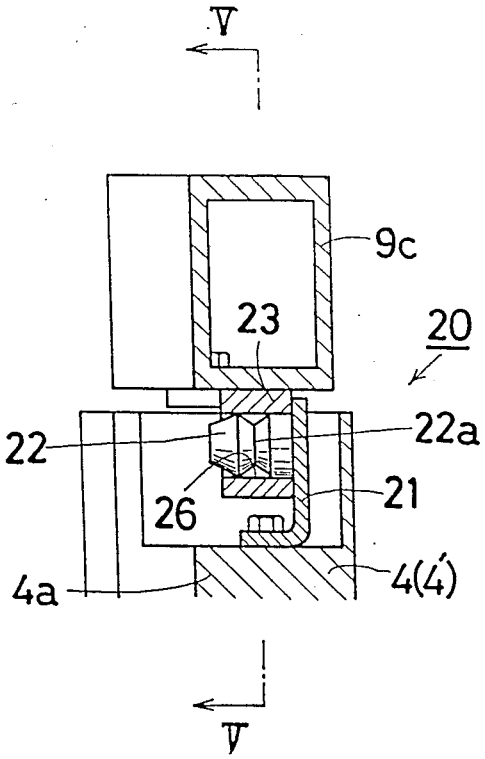
FIG. 4 is a sectional view of a releasable coupling device useful for the apparatus of FIG. 1.
Figure 5:
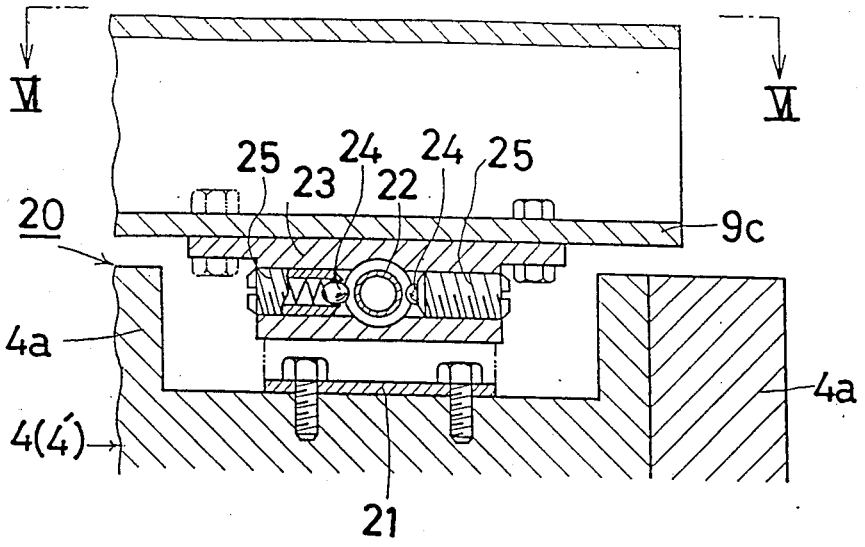
FIG. 5 is a sectional view taken along the line V—V of FIG. 4.

The releasable coupling device 20 is shown in more detail in FIGS. 4 and 5. A latch stud 22 with an annular V-shaped groove 22*a* is secured to a bracket 21 which is secured to the top of the door leaf 4. Secured to the bottom of the support beam 9*c* is a member 23 with a latch bore 26 for receiving the latch stud 22 and an intersecting longitudinal bore into which a pair of cylinders 25 are threaded. As best shown in FIG. 5, each cylinder 25 has a ball 24 pushed toward its tip by a compression spring so as to engage the annular groove 22*a* in such a manner that the latch stud 22 may be released from the engagement. When the circular door assembly operates as a sliding door, the latch stud 22 is fitted into the latch hole 26 of the bored member 23 so that the balls 24 engage the annular groove 22*a*, thus coupling the door leaf 4 to the support beam 9*c*.

Figure 6:
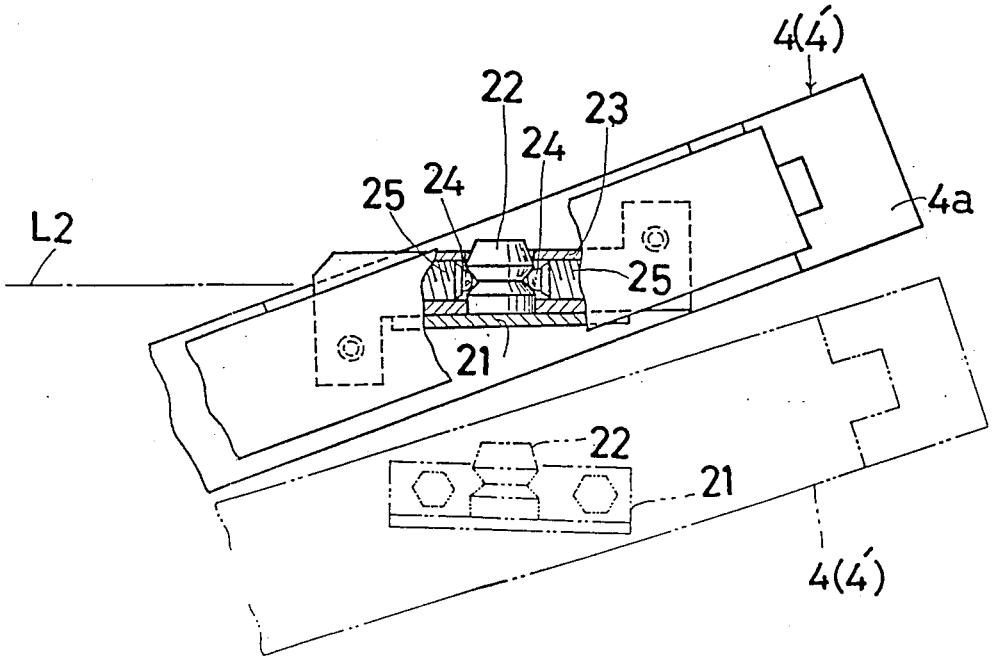
FIG. 6 is a top view, partially broken away, taken from the line VI—VI of the FIG. 5.

When the circular door apparatus is used as a hinged door, the door leaf 4 is pushed toward the outside so as to disengage the balls 24 from the annualr groove 22*a*, thus releasing the door leaf 4 from the support beam 9*c* as shown in two-dot chain line in FIG. 6. When the latch stud 22 is released from the bored member 23, its direction of movement should be perpendicular to a line L2 connecting the rotatable shaft 30 and the latch stud 22 so taht the bracket 21 is mounted on the door leaf 4 in such an angle that the axis of the stud 22 may be perpendicular to the line L2.

Figure 10:
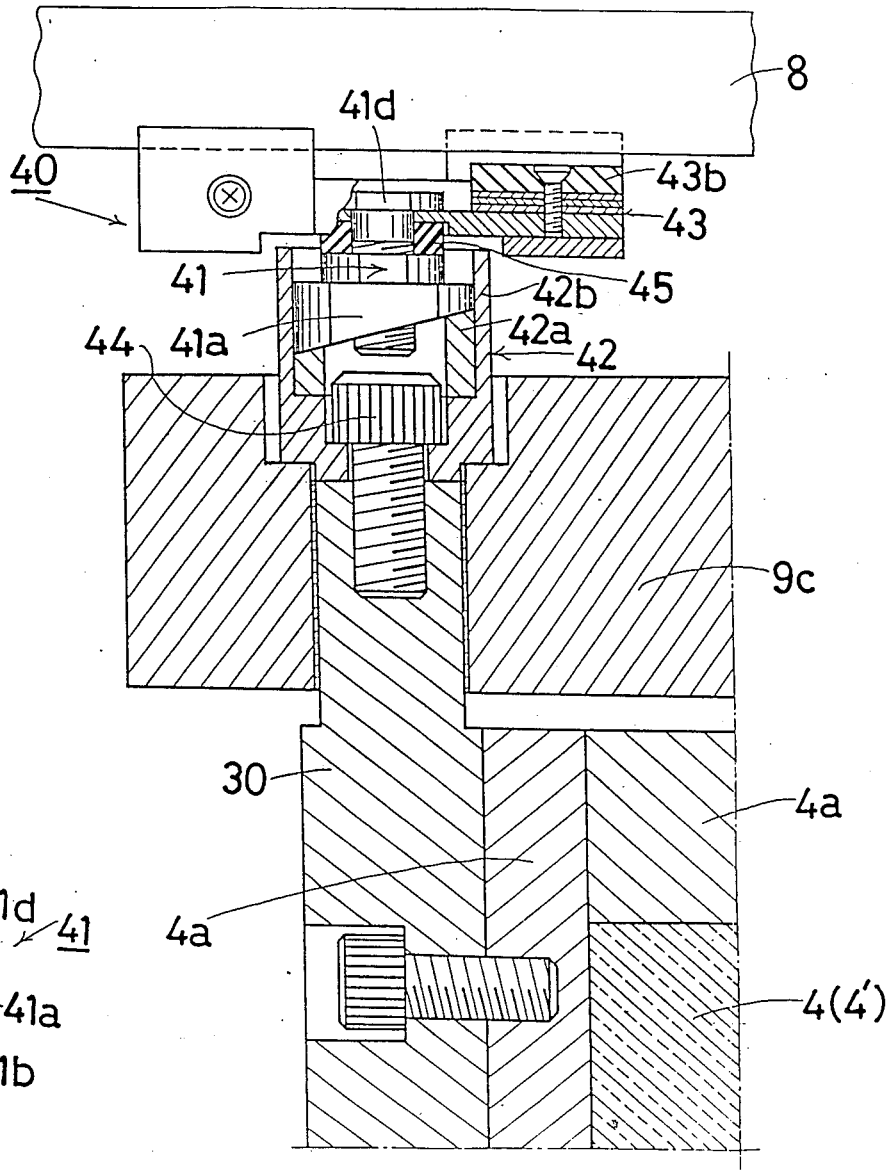
FIG. 10 is a sectional view of the upper hinge mechanism secured to a door via a shaft.
Figure 7:
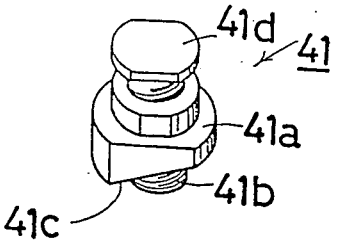
FIGS. 7–9 are perspective views of an upper plunger, a cylinder cam, and an upper abutment, respectively, of an upper hinge mechanism useful for the apparatus of FIG. 1.
Figure 8:
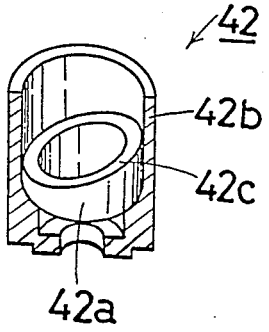
Figure 9:
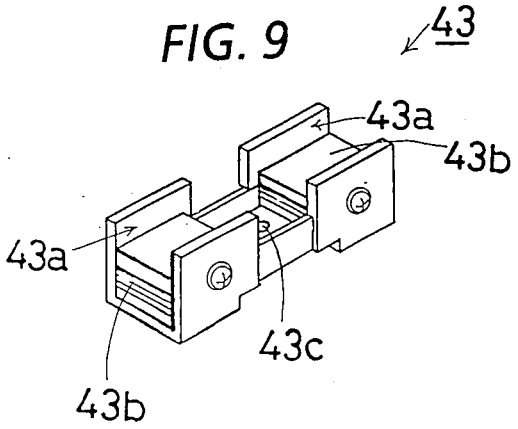

Upper and lower hinge mechanisms 40 and 50 are secured to the upper and lower ends of the door leaf 4 to prevent sagging of the free end due to its own weight. As FIG. 10 shows, the upper hinge mechanism 40 includes an upper abutment 43 slidably fitted over the track 8, an upper pluger 41, and an upper cam assembly 42 secured to the top of the saft 30 with a bolt 44. As FIG. 7 shows, the upper plunger 41 consists of a bolt 41*b* with a flat head 41*d* and a cam nut 41*a* with a slanting bottom 41*c* threaded over the bolt 41*b*. As FIG. 8 shows, the upper cam assembly 42 consists of a cylindrical housing 42*b* and a cylindrical cam member 42*a* with a slanting top 42*c* fixedly fitted in the cylindrical housing 42*b*. As FIG. 9 shows, the upper abutment 43 has a longitudinal channel 43*a* slidably fitted over the track 8, a central aperture through which the bolt 41*b* can be inserted, and a pair of rectangular shoes 43b made of rubber or the like, which abut the bottom of the track 8 when the door leaf is turned to a certain angle.

In FIG. 10, the bolt 41b is threaded into the cam nut 41a through the aperture 43c of the upper abutment 43 and an elastic member 45 in such a manner that the plunger 41 may be pushed up against the spring force of the elastic member 45. The cylindrical housing 42b is secured with a bolt 44 to the top of the shaft 30 which is rotatably supported by the support beam 9c. The cam nut 41a is pivotally and reciprocatedly fitted into the cylindrical housing 42b to pivotally connect the shaft 30 to the track 8 through the support beam 9c. The shaft 30 is secured to a vertical frame 4a of the door leaf 4 with a bolt.

As shown in this figure, when the circular door assembly operates as a sliding door, the slanting bottom 41c of the plunger 41 and the slanting top 42c of the cam assembly 42 are brought into close contact with each other so that there is a certain gap between the shoes 43b of the upper abutment 43 and the track 8. On the other hand, when the door leaf 4 is turned about the shaft 30, the cam assembly 42 is turned along with the shaft 30 to push the plunger 41 upwards until the shoes 43b abut the track 8, thus fixing the shaft 30 in place.

As FIG. 14 shows, the lower hinge mechanism 50 includes a lower cam assembly 51 secured to the door leaf 4, a lower plunger 52, and a lower abutment 53. As FIG. 11 shows, the lower cam assembly 51 consists of a bracket 51c, a cylindrical housing 51b welded to the bracket 51c, and a cylindrical cam member 51a with a slanting bottom 51b fixedly fitted in the housing 51b. As FIG. 12 shows, the lower plunger 52 consists of a bolt member 52b with a flat head 52d and a retainer disk 52c on the opposite end, and a lower cam nut 52a with a slanting top 52e threaded over the bolt member 52b. As FIG. 13 shows, the rectangualr lower abutment 53 has a central aperture 53a through which the bolt member 52b can be inserted.

In FIG. 14, a first spring 54 having a small spring constant is mounted on the housing 51b and held in place by the retainer disk 52c. The bolt member 52b is inserted through the aperture 53a of the lower abutment 53 and a second spring 55 having a large spring constant and threaded into the lower cam nut 52a, which is pivotally and reciprocatedly fitted in the lower housing 51b and abuts the lower cam member 51a. The bracket 51c of the cam assembly 51 is secured to a vertical frame 4a of the door leaf 4 with bolts 56. The lower abutment 53 is fitted in a circular floor channel 57 provided along the lower edge of the fixed panel 2 in such a manner that it may slide along but not rotate within the circular floor channel 57.

When the door leaf 4 is not turned at the lower hinge mechanism 50, the slanting bottom 51d of the lower cam 51a and the slanting top 52e of the lower cam nut 52a are brought into close contact with each other so that there is a certain gap between the lower abutment 53 and the bottom 57a of the floor channel 57. When the door leaf 4 is turned, the cam assembly 51 is turned, pushing down the lower plunger 52 while compressing the first spring 54 until the lower abutment 53 abuts the bottom 57a of the floor channel 57. When the door leaf 4 is further turned, the lower plunger 52 is pushed down against the second spring 55, with its flat head 52d moved downwardly from the top 53b of the lower abutment 53 and pressed against the bottom 57a of the floor channel 57 while the lower abutment 53 is firmly held against the bottom 57a by the second spring 55.

As described above, the conventional circular door assembly is provided with passenger sensors in front of and at the back of an inside or outside door to sense the presence of a passenger. When a passenger comes into the sensing area, the circular door operating apparatus opens the door as a sliding door. According to the invention, however, the door is also opened as a hinged door by pushing it toward the outside to bring the releasable coupling device 20 into a release position and the sliding door function to a stop position. This switching between the sliding and hinged door functions will be described. Since all the door leaves are similar, only the left-side outside door leaf 4 as viewed in FIG. 1 will be described.

Figure 15:
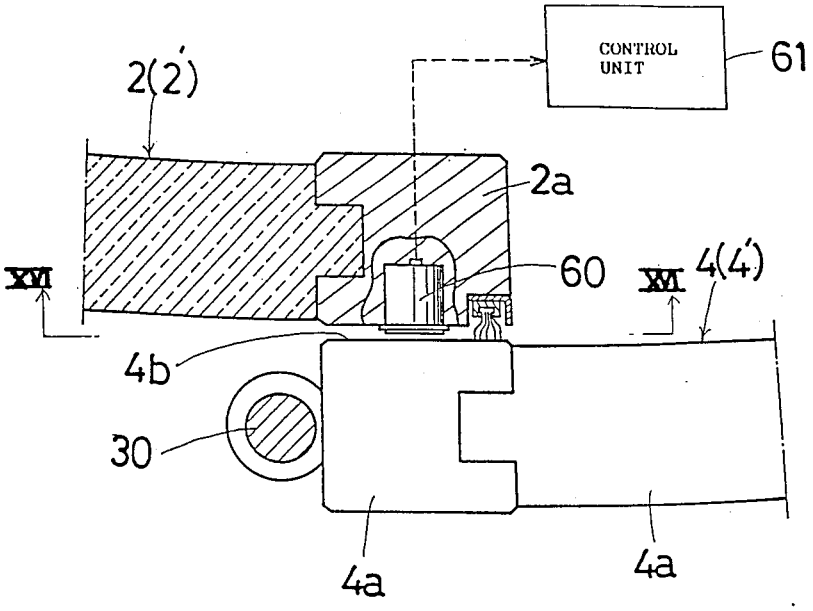
FIG. 15 is a sectional view of part of a fixed panel with a photoelectric switch embeded near its upper free end.
Figure 16:
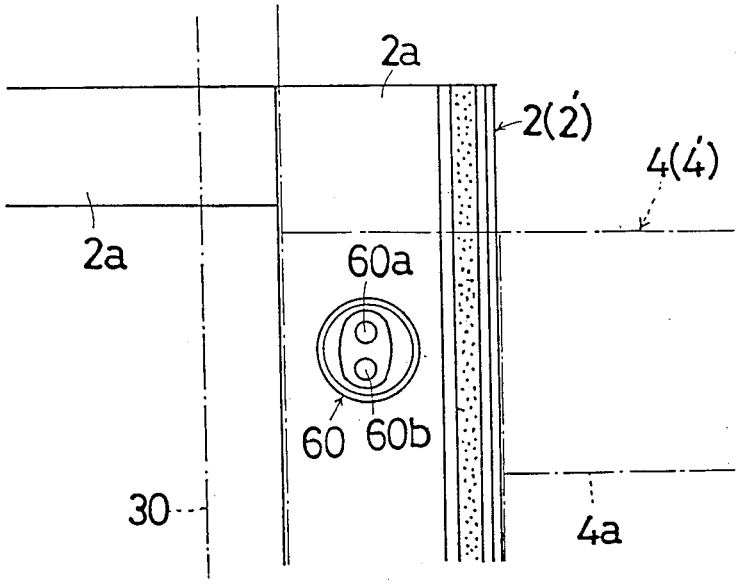
FIG. 16 is a front view of the upper free end of the fixed panel taken from the line XVI—XVI of FIG. 15.

As FIGS. 15 and 16 show, a photoelectric switch 60 is mounted in a frame 2a of the fixed panel 2 so as to face an upper side 4b of a vertical frame 4a and a top horizontal frame 4a of the door leaf 4. In response to a signal from the photoelectric switch 60, a control unit 61 of the controller 18 mounted within the transom 6 controls the door driving mechanism 11. As best shown in FIG. 16, the photoelectric switch 60 consists of a light source 60a for emitting modulated infrared light and a receptor 60b for receiving the reflected light from the frame side 4b. These light source 60a and the receptor 60b are oriented to assure that the receptor 60b always receive the reflected light when the door operates as a sliding door.

Figure 17:
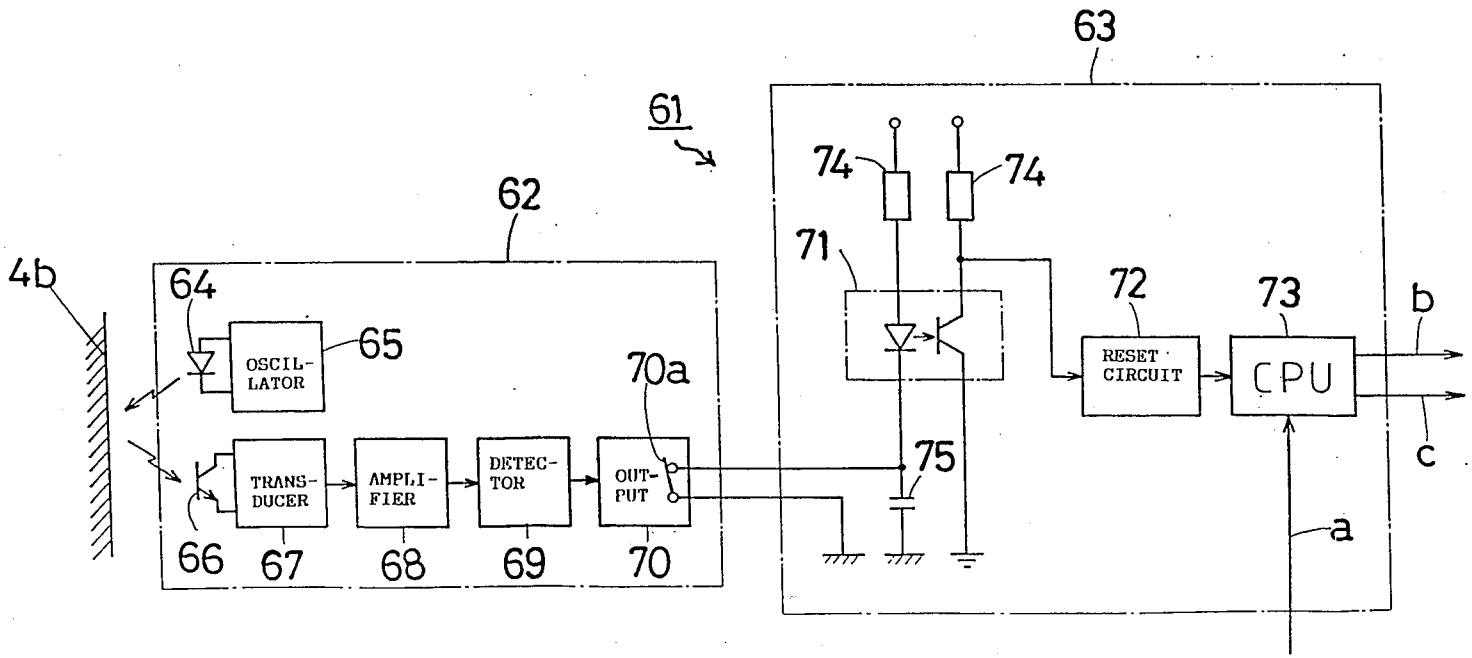
FIG. 17 is a block diagram of a control unit useful for the apparatus of FIG. 1.

FIG. 17 shows the control unit 61 which includes a detecting section 62 and a control section 63. The detecting section 62 consists of a light emitting diode 64 mounted in the light source 60a, an oscillator 65 for supplying a predetermined signal to the LED 64, a light receiving element 66 mounted in the receptor 60b, a transducer 67 for converting the received light to an electrical signal, an amplifier 68 for amplifying the electrical signal, a detector 69 for detecting only the electrical signal corresponding to the emitted light from the LED 64, and an output circuit 70 in response to a signal from the detector 69 to turn on or off a switch 70a. The switch 70a is held on as long as the receptor 66 receives the reflected light of the LED 64.

The control section 63 consists of a photocoupler 71 into which a signal is input from the output circuit 70, a reset circuit 72 connected to the output of the photocoupler 71, and a central processing unit 73 in response to a signal from the reset circuit 72 to become a logical level High or Low. The CPU 73 also receives a signal (a) from the aforementioned passenger sensor and outputs an opening or closing signal (b or c), which actuates the door driving mechanism 11 to open or close the doors 4 as a sliding door. The control section 63 also includes a pair of pull-up resistors 74 and a chattering preventive capacitor 75

When the doors 4 operate as sliding doors or the output switch 70a is on, a signal is input to the reset circuit 72 via the photocoupler 71. The output signal from the reset circuit 72 pulls up the reset terminal of the CPU 73 so that the CPU 73 becomes operable. Under these conditions, in response to a signal (a) from the passenger sensor, the CPU 73 outputs an opening or closing signal (b or c).

When the doors 4 operate as hinged doors, the side 4b of the door frame 4a is angled against the light source 60 so that the receiving element 66 receives no or little reflected light of the LED 64, thus turning off the output switch 70*a*. This brings the reset terminal of the CPU 73 to a logical level Low, resetting the CPU 73. While the CPU 73 is reset, it outputs neither opening signal (b) nor closing signal (c) even if it receives a signal (a) indicating the presence of a passenger or passengers in the sensing area, thus disabling the sliding door operation.

Figure 18:
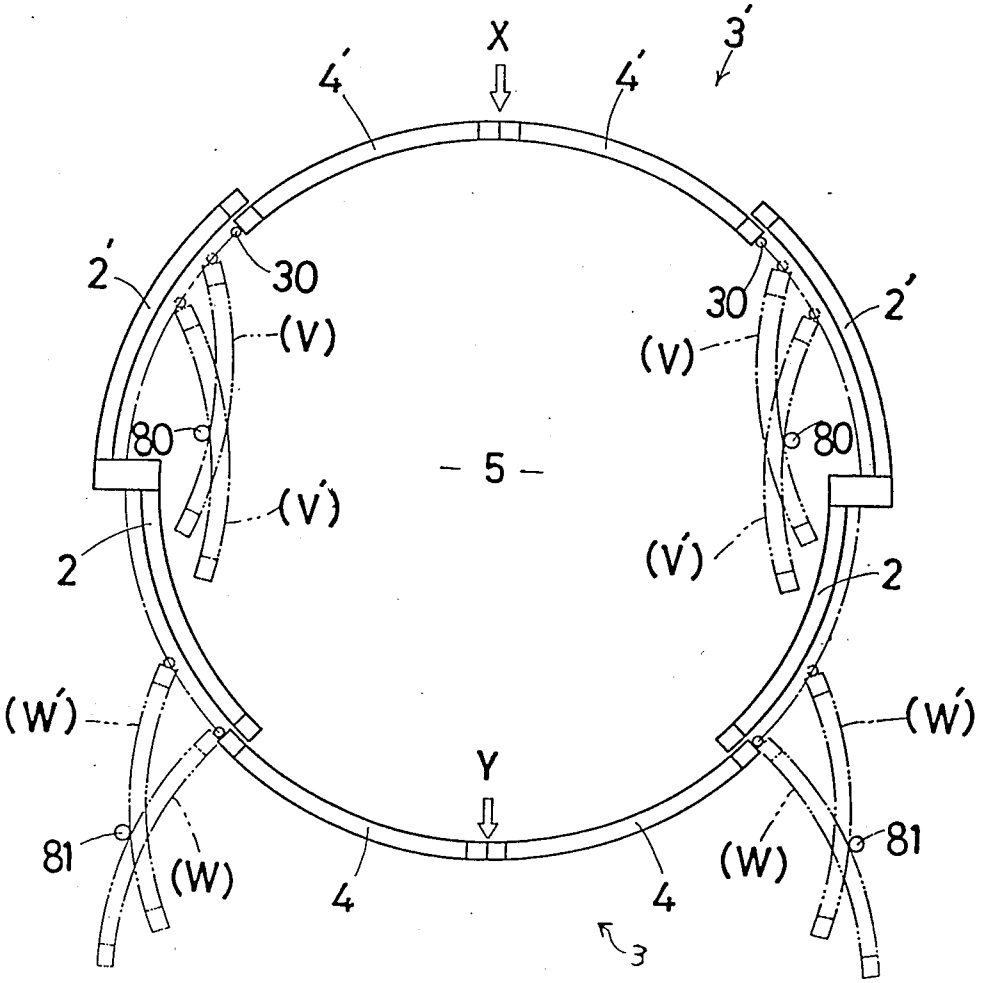
FIG. 18 is a top view of the circular door assembly of FIG. 1 showing its hinged door operation in two-dot line.
Figure 19:
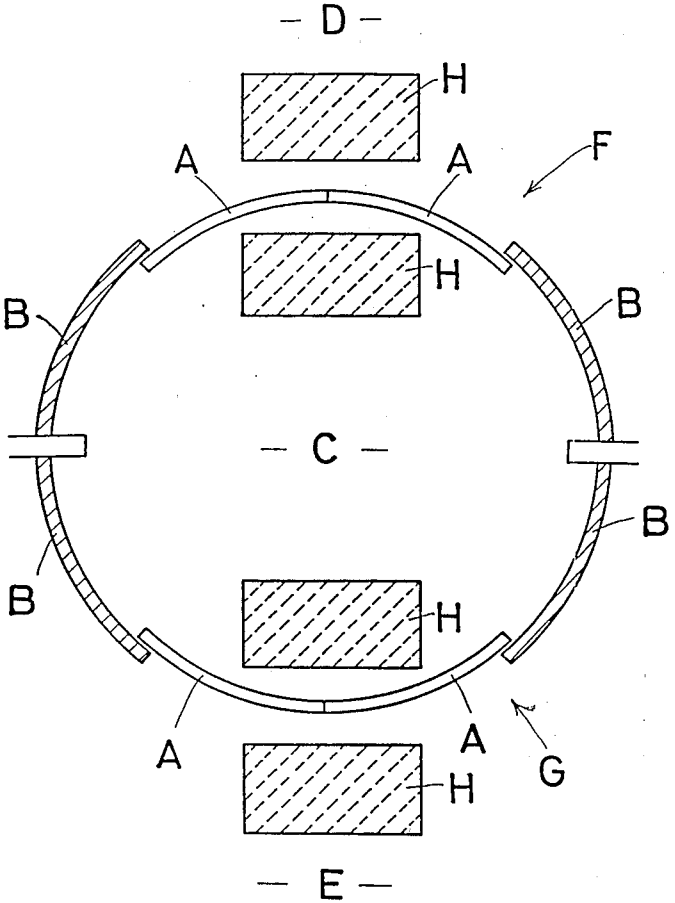
FIG. 19 PRIOR ART
FIG. 19 is a top view of a conventional circular door assembly.

As FIG. 18 shows, in the case of an emergency, such as a fire or earthquake, evacuees or passengers within the building may open the inside doors 4 as hinged doors about the shaft 30 by push them toward the outside as indicated by an arrow X until they abut stoppers 80 shown in two-dot chain lines (V) or (V'). The passengers who have entered the wind blocking compartment 5 through the inside passage 3' now can open the outside doors 4 as hinged doors by pushing them toward the outside indicated by an arrow Y until they abut stoppers 81 as shown in two-dot chain lines (W) or (W'), and leave the building through the outside passage 3. In the case of a power failure, too, the doors 4 and 4' can, of course, be manually opened as hinged doors.

As described above, according to the invention, each door 4 or 4' can be easily released from the hanger beam 9*c* by means of the releasable coupling device 20. The shaft 30 is supported in place by the upper and lower hinge mechanims 40 and 50. The control unit 61 disables the sliding door function when the doors are hinged open, thus assuring the safety of the hinged door operation. In the above illustrated embodiment, the wind blocking chamber has a cicular cross-section but may take another form such as an oval or ellipse.

According to the invenion, each door of the circular doors is provided with a releasable coupling device and upper and lower hinge mechanisms so that the doors can be opened toward the outside by simply pushing them in the direction of escape, thus assuring rapid and safety escape.

While a preferred embodiment of the invention has been described using specific terms, such description is illustrative purposes only, and it is to be understood that changes and variations may be made without departing from the spirit and scope of the invention as recited in the appended claims.

What is claimed is:

1. A method of operating a circular door assembly, which comprises the steps of:

providing a closed curved transom and a closed curved floor channel installed at a passage of a building;

pivotally mounting a pair of center-open, sliding curved doors between said curved transom and floor channel and two pairs of opposing curved fixed panels, each pair provided on opposite sides of each of said doors, so as to form an enclosure defining a wind blocking compartment and on the inside of each of said doors so as to allow each of said doors to pivot toward the outside of said building; and releasably coupling central part of each door to said transom in such a manner that a passenger may open said door as a hinged door by simply pushing said central part of said door toward the outside, thus allowing rapid evacuation from said building in the case of an emergency.

2. Apparatus for operating a circular door assembly, which comprises:

a closed curved transom enclosing a curved track;

a closed curved floor channel provided at a passage of a building;

two pairs of door leaves, each pair forming a center-open, sliding curved door provided between said curved transom and said floor channel;

two pairs of curved fixed panels, each pair provided on opposite sides of each of said curved doors so as to form an enclosure defining a wind blocking compartment and on the inside of each of said curved doors so as to allow said door to pivot toward the outside of said building;

two pairs of hanger assemblies, one for each door leaf to slidably mount said door leaf on said curved track;

a pair of pulley mechanisms, one for each door to move a pair of door leaves of said door in opposite directions along said track to thereby open or close said passage;

upper and lower hinge mechanisms secured to a hinged side of each door leaf to pivotally mount said door leaf on said curved transom and said curved floor channel, respectively; and releasable coupling means for releasably coupling a free end of each door leaf to each of said hanger assemblies so that a passenger may open said center-open sliding door as a hinged door by simply pushing a central part of said center-open sliding door.

3. The apparatus of claim 2 wherein said upper hinge mechanism comprises:

an upper cylindrical cam assembly fixedly mounted on a top of a shaft secured to an upper hinged side of each door leaf for turning along with said door leaf;

an upper plunger with a cam nut pivotally and reciprocatedly fitted in said upper cylindrical cam assembly; and an upper abutment fixedly mounted on said upper plunger through an elastic member so that when said door leaf is turned by a first predetermined angle, said upper abutment is pressed against said curved track to firmly support said upper hinge mechanism on said curved track.

4. The apparatus of claim 2 wherein said lower hinge mechanism comprises:

a lower cylindrical cam assembly secured to a lower hinged side of each door leaf for turning along with said door leaf;

a lower plunger with a cam nut pivotally and reciprocatedly fitted in said lower cylinderical cam assembly through a first spring; and a lower abutment mounted on said plunger through a second spring having a spring constant greater than that of said first spring so that when said door leaf is turned by a predetermined second angle, said lower abutment is pressed against a bottom of said curved floor channel to firmly support said lower hinge mechanism on said floor channel.

5. The apparatus of claim 2, wherein said releasable coupling means comprises:

a latch stud with its axis oriented in a direction perpendicular to a line connecting said latch stud and said upper hinge mechanism; and a bored member with a latch bore having its axis oriented in the same direction as that of said latch stud for receiving said latch stud to thereby releasably couple said door leaf to said hanger assembly.

6. The apparatus of claim 2, which further comprises:

a latch sensor mounted on an upper free end of each door leaf to generate a signal indicative of turning of said door leaf; and a control unit mounted within said curved transom in response to said signal to disable said door leaf to operate as a sliding door.

7. The apparatus of claim 2, wherein said pulley mechanism comprises:

a central bracket secured to said curved track;

a pair of toothed pulleys pivotally mounted on said central bracket;

a pair of toothed timing belts, one for each of said toothed pulleys; and said center toothed pulleys being disposed in such a manner that a gap between outsides of said toothed timing belts around said toothed pulleys may be smaller than the height of teeth of said timing belts.

* * * * *

UNITED STATES PATENT AND TRADEMARK OFFICE

CERTIFICATE OF CORRECTION

PATENT NO. : 4,785,579

DATED : Nov. 22, 1988

INVENTOR(S) : Sugiyama et al

It is certified that error appears in the above-identified patent and that said Letters Patent is hereby corrected as shown below:

Title page:

In the Assignees of the above patent; change "Nippon Air Brake Co., Ltd.; Tajima Junzo Seisakusho Co., Ltd., both of Tokyo, Japan" to --Nippon Air Brake Co., Ltd., Kobe; Tajima Junzo Seisakusho Co., Ltd., Tokyo, both of Japan--.

Signed and Sealed this

Third Day of October, 1989

*Attest:*

*Attesting Officer*

DONALD J. QUIGG

*Commissioner of Patents and Trademarks*